United States Patent [19]

Sharp

[11] 4,066,219

[45] Jan. 3, 1978

[54] TWINE WINDING ASSEMBLY

[75] Inventor: Austin S. Sharp, Stone Mountain, Ga.

[73] Assignee: Wellington Puritan Mills, Inc., Madison, Ga.

[21] Appl. No.: 718,409

[22] Filed: Aug. 30, 1976

[51] Int. Cl.[2] ..... B65H 75/30; B65H 79/00

[52] U.S. Cl. ..... 242/46.2; 242/46.21; 242/118.2; 242/118.32

[58] Field of Search ..... 242/46.2, 46.21, 46.3, 242/46.4, 46.5, 46.6, 118.3, 118.31, 118.32, 118.7, 68.5

[56] References Cited

U.S. PATENT DOCUMENTS

| | | | |
|---|---|---|---|
| 2,401,309 | 6/1946 | Markle, Jr. | 242/46.2 |
| 2,654,542 | 10/1953 | Parsons | 242/46.6 |
| 2,757,877 | 8/1956 | Sinnett | 242/46.4 UX |
| 3,596,845 | 8/1971 | Rajnoha et al. | 242/46.6 |
| 3,934,767 | 1/1976 | Jones | 242/118.7 X |

*Primary Examiner*—Stanley N. Gilreath

*Attorney, Agent, or Firm*—Newton, Hopkins & Ormsby

[57] ABSTRACT

A twine winding assembly comprising a spool constructed of malleable material and having a central bore and a spindle for a twine winding machine, the spindle having exterior spool bore engaging surfaces which project beyond the diameter of the bore so as to frictionally engage the bore thereon. The cross-section of the spindle can be of any suitable configuration, such as rectangular, polygonal, elliptical, circular or other articulated surface.

2 Claims, 8 Drawing Figures

TWINE WINDING ASSEMBLY

BACKGROUND OF THE INVENTION

1. Field of the Invention

This invention relates to an apparatus for forming balls of twine and more particularly to a twine winding assembly.

2. Description of the Prior Art

In preparing a ball of thread or twine, a cylindrical spool is usually utilized, the spool having a central bore therethrough which is fitted over the spindle of a winding machine. The outer surface of the spindle is provided with laterally extending spring-biased arms or fingers which are operable to engage the surface of the bore so as to prevent the spool from rotating about the spindle during the winding process.

Those fingers are fairly delicate and, as such, break off which renders that spindle inoperative. The capacity of the winding machines is, of course, thereby diminished due to the broken fingers on the spindles.

Parsons, U.S. Pat. No. 2,654,542, discloses a plastic spool having longitudinal grooves in its bore that receive spring arms or wires which are longitudinally arranged on a hexagonal spool-receiving spindle shank.

The disadvantages with the prior art structures include their use of blades or spring arms which are easily susceptible to breakage. Additionally, means had to be provided in the spool bore, such as grooves, to properly align the spool on the spindle.

SUMMARY OF THE INVENTION

The above disadvantages are overcome by the present invention which comprises a twine winding assembly including a twine receiving spool constructed of a malleable material, such as polypropylene or structural foam, and having a bore centrally disposed therethrough and a spindle on which the spool is manually placed.

The spindle has a spool receiving shank portion which is in the shape of an octagon in the preferred form. Means are provided on the shank for limiting the axial movement of the spool on the shank, the limiting means comprising lugs which laterally extend from the outer periphery of the shank to engage the bottom surface of the spool.

The shank may be of various other shapes, including hexagonal, pentagonal, square and circular. Any other articulated surface may be utilized on the spindle as long as bore engaging surfaces are presented on the exterior of the shank which are of greater dimensions than the bore.

In the operation of the invention, the spool is mounted on the spindle by having the top portion of the shank engage the bore. The spool is manually pressed downwardly upon the shank until it contacts the lugs. Since the interior surface of the spool bore is malleable, it assumes the shape of the shank and is thus frictionally secured to the shank by means of the bore engaging surfaces on the shank.

It is, therefore, an object of the present invention to provide an improved spool for winding twine thereon and an improved spindle for receiving the spool thereon.

Another object of the present invention is to provide a twine spool which may be quickly and easily secured onto and removed from a winding spindle.

An object of the present invention is to provide a spindle for a twine winding machine, the spindle having exterior surfaces which frictionally engage the malleable bore of a spool.

A further object of the present invention is to eliminate the need for any specific alignment of the spool relative to the spindle.

DESCRIPTION OF THE ILLUSTRATED EMBODIMENTS

Figure 1:
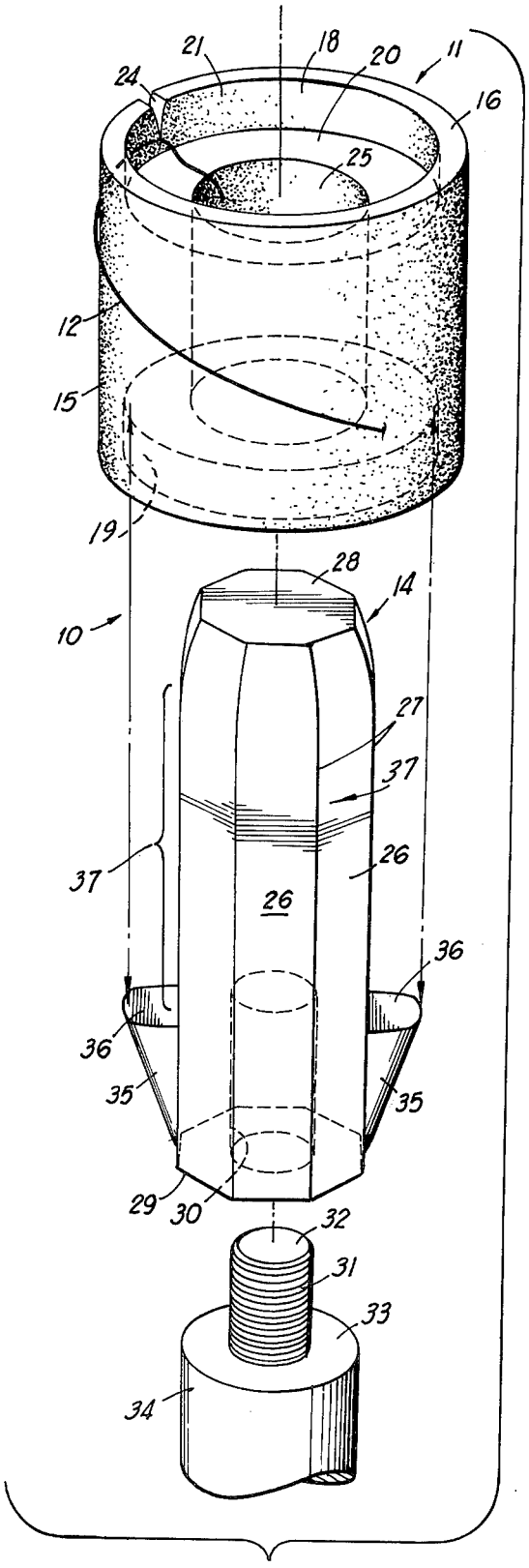
FIG. 1 is an exploded perspective view of the preferred embodiment of the present invention.
Figure 2:
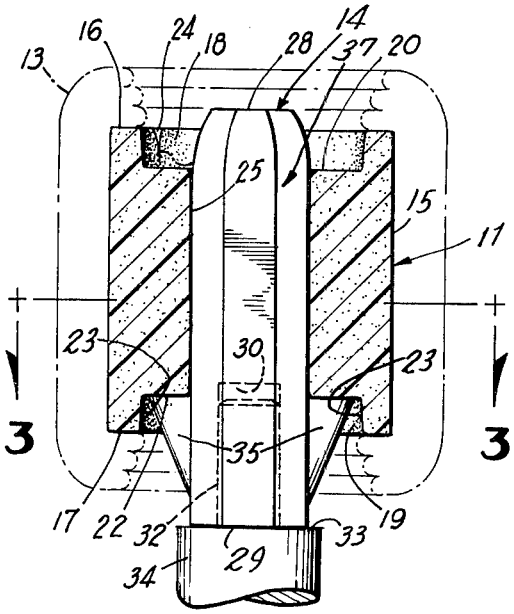
FIG. 2 is a side elevational view in partial cross-section of the invention shown in FIG. 1.
Figure 3:
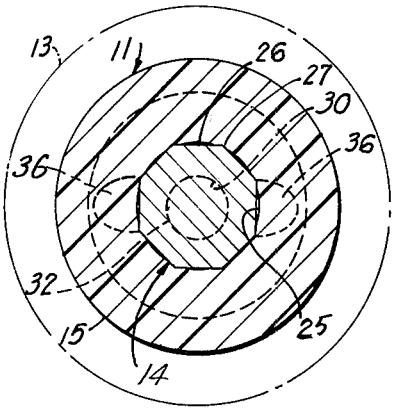
FIG. 3 is a cross-sectional view taken along line 3—3 in FIG. 2; and, FIGS. 4 – 8 are top plan views of other embodiments of the present invention.
Figure 4:
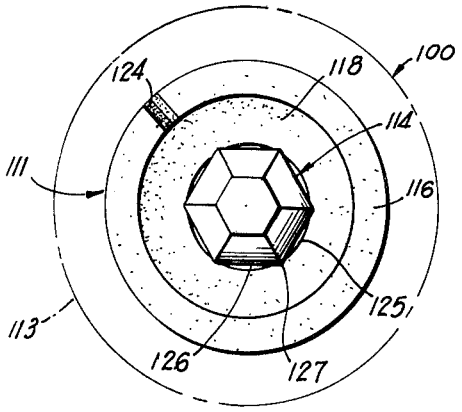

Referring now in detail to the embodiments chosen for the purpose of illustrating the present invention, numeral 10 denotes generally the winding assembly depicted in FIGS. 1–3 and is the preferred embodiment.

The assembly 10 comprises a spool 11 or core for receiving thereon a continuous length of twine 12 to form a ball 13 (shown in phantom lines in FIGS. 2 and 3) and a winding spindle 14 which receives the spool 11. The spool 11 is of unitary design and is preferably constructed of a malleable material, such as polypropylene or structural foam, and has a smooth, cylindrical outer peripheral surface 15 with flat top and bottom 16, 17.

Circular depressions 18, 19 are countersunk in top 16 and bottom 17, respectively, adjacent the outer periphery 15 of the spool 11 to provide depressed top surface 20 and flange 21 and depressed bottom surface 22 and flange 23. A V-shaped groove 24 is formed through top 16 into flange 21. A spool bore 25 of uniform diameter is centrally disposed through spool 11.

The spindle 14 is octagonal in shape and comprises eight sections 26 joined along their edges 27. The edges 27 provide longitudinally disposed bore engaging surfaces which extend beyond the diameter of the bore 25. The sections 26 taper inwardly adjacent their upper ends and terminate in flat top 28. The spindle 14 has a flat bottom 29 through which is tapped opening 30 having threads which are complimentary to the threads 31 on projection 32 which extends from the top surface 33 of circular mounting element 34. Element 34 is on a conventional winding machine and is powered to rotate about its longitudinal axis in the conventional manner.

Tapering lugs 35 laterally extend from opposed sections 26 adjacent bottom 29 and are provided with flat top surfaces 36. The area on spindle 14 which actually engages the bore 25 is referred to as shank 37 and includes that portion of sections 26 which extend from surface 36 upwardly until sections 26 begin to taper inwardly.

In the operation of the first embodiment, the spool 11 is manually placed on spindle 14 by forcing bore 25 onto shank 37. As seen in FIG. 3, the edges 27 bite into the surface of bore 25 since the edges 27 extend beyond the diameter of bore 25. The spool 11 is thus prevented from freely rotating about spindle 14. The axial movement of spool 11 on spindle 14 is limited by having surfaces 36 contact surface 22. Thus, the depression 19 should have a diameter sufficient to receive therein the top surfaces 36 of lugs 35 with surfaces 36 contacting bottom surface 22. However, the depth of depressions 18, 19 should not be so great that they weaken the structural integrity of the spool 11. Referring to FIG. 2, it can be seen that with the spool 11 completely engaging the shank 37, the tapering portion of spindle 14 extends above surface 20. The tapering portion aids in the placement of spool 11 on spindle 14.

The free end of twine 12 is secured in groove 24, as shown in FIG. 1. Element 34 is caused to rotate about its longitudinal axis. Thus, spindle 14 and spool 11 rotate with twine 12 being continuously deposited on surface 15 to form a ball of twine 13 of selected diameter. The spool 11 is then removed from spindle 14. After its removal from spindle 14, the bore 25 will have assumed a substantially octagonal shape in cross-section. As can be seen, the present invention eliminates the need for the specific alignment of the spool 11 relative to the spindle 14, since the edges 27 can engage the bore 25 anywhere along its surface.

FIGS. 4 – 8 illustrate other embodiments of the present invention. Numeral 100 denotes the embodiment shown in FIG. 4 and includes a spool 111 and a spindle 114. The spool 111 has a top surface 116 with depression 118 and groove 124 therein and central bore 125 therethrough.

The spindle 114 is shown as being hexagonal in cross-section and formed by sides 126 joined along edges 127 which "bite into" the surface of bore 125. A ball of twine 113 is shown in phantom lines.

Figure 5:
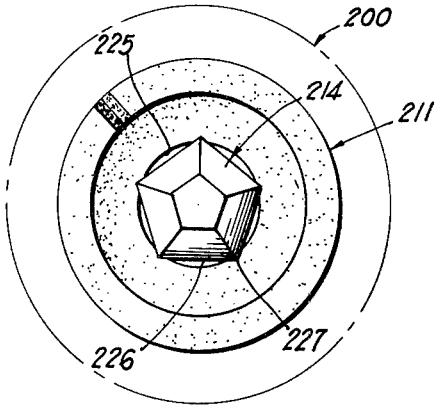

FIG. 5 shows embodiment 200 with spool 211 and spindle 214. The bore 225 centrally projects through the spool 211. The spindle 214 is pentagonal in shape with sides 226 being joined along edges 227 which frictionally engage the inner surface of bore 225.

Figure 6:
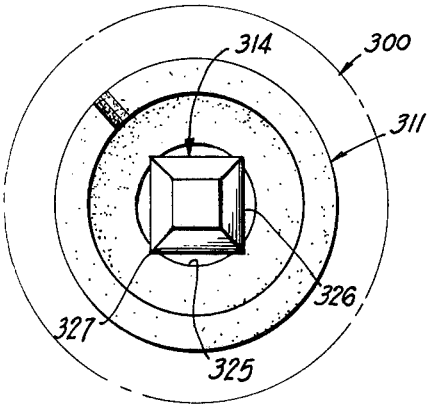

FIG. 6 shows embodiment 300 being comprised of spool 311 and a square-shaped spindle 314 which extends through spool bore 325 by the frictional engagement of edges 327 therein.

Figure 7:
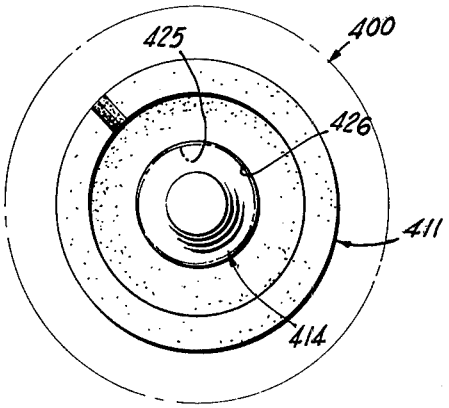

Embodiment 400 is illustrated in FIG. 7 and comprises spool 411 and circular spindle 414. The bore 425 is shown in phantom lines and represents the bore prior to the insertion of the spindle 414 therethrough. With spindle 414 being circular and having a bore-engaging diameter which is greater than the diameter of bore 425, the entire exterior surface 426 of spindle 414 along its shank presents a bore engaging surface.

Figure 8:
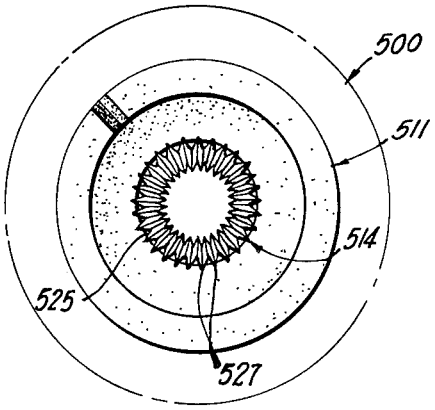

FIG. 8 represents embodiment 500 with spool 511 and spindle 514. The bore 525 axially extends through spool 511. Spindle 514 has an articulated outer surface to provide a plurality of bore-engaging surfaces 527 which contact the surface of bore 525.

What is claimed is:

1. In a textile winding assembly, a cylindrical spool adapted to have a textile strand wound on its periphery, said spool being unitary and formed entirely of structural foam, said spool having a central axial through bore of predetermined constant diameter, and said spool provided in its opposite end faces with recesses of equal depths below the end faces and substantially equal diameters and forming on said spool a pair of opposite end flat spool locator faces below the spool end faces and annular flange portions surrounding the locator faces, and a spindle for supporting and driving the spool rotationally on the axis of said bore and adapted to be coupled to a rotational element of a winding machine, said spindle having an elongated shank portion insertable entirely through said bore and having bore-engaging projections which extend radially beyond the diameter of the bore, whereby entry of the shank portion through said bore will deform said bore permanently by crushing said structural foam adjacent to said projections and thereby allowing said spindle to create a positive interlocking driving engagement with said spool, and a pair of radiating lugs on said spindle projecting beyond opposite sides of said shank and having a pair of flat end faces in lateral alignment across the shank, said end faces adapted to abut one of said flat spool locator faces when said spool is assembled on the spindle.

2. In a textile winding assembly as defined in claim 1, and a textile strand receiving and holding notch formed in at least one annular flange at one end of said spool.

* * * * *